United States Patent [19]

Sanders, Jr.

[11] Patent Number: 4,626,294

[45] Date of Patent: Dec. 2, 1986

[54] LIGHTWEIGHT ARMOR PLATE AND METHOD

[75] Inventor: Robert E. Sanders, Jr., New Kensington, Pa.

[73] Assignee: Aluminum Company of America, Pittsburgh, Pa.

[21] Appl. No.: 738,613

[22] Filed: May 28, 1985

[51] Int. Cl.[4] ..... C22F 1/04

[52] U.S. Cl. ..... 148/11.5 A; 148/439; 148/440

[58] Field of Search ..... 148/11.5 A, 2, 437, 148/439, 440

[56] References Cited

U.S. PATENT DOCUMENTS

| | | | |
|---|---|---|---|
| 1,856,615 | 5/1932 | Archer et al. | 420/542 |
| 1,910,656 | 5/1933 | Tullis et al. | 420/543 |
| 1,932,837 | 10/1933 | Wood | 75/1 |
| 1,932,846 | 10/1933 | Dean et al. | 75/1 |
| 1,932,856 | 10/1933 | Wood | 75/1 |
| 2,096,010 | 10/1937 | Sicha | 75/147 |
| 3,232,796 | 2/1966 | Anderson | 148/12.7 |
| 3,346,372 | 10/1967 | Jagaciak | 75/147 |
| 3,502,448 | 3/1970 | Anderson et al. | 29/183.5 |
| 3,556,872 | 1/1971 | Jagaciak | 148/11.5 |
| 3,560,269 | 2/1971 | Anderson et al. | 148/11.5 |
| 3,649,227 | 3/1972 | Fetzer et al. | 29/197.5 |
| 3,708,352 | 1/1973 | Brown et al. | 148/11.5 |
| 4,284,437 | 8/1981 | Baba et al. | 148/11.5 |
| 4,469,537 | 9/1984 | Ashton et al. | 148/440 |

FOREIGN PATENT DOCUMENTS

| | | |
|---|---|---|
| 1347/31 | 8/1931 | Australia . |
| 55-11110 | 1/1980 | Japan . |

OTHER PUBLICATIONS

Alloy Digest, Sep. 1958, "Aluminum 5456".

Military Specification, "Armor Plate, Aluminum Alloy, Weldable 5083 and 5456", MIL-A-46027F(MR), Jun. 10, 1976 and MIL-A-46027F(MR), Amendment 1, Oct. 19, 1981.

*Primary Examiner*—R. Dean

*Attorney, Agent, or Firm*—Carl R. Lippert

[57] ABSTRACT

Aluminum armor plate containing relatively high amounts of magnesium, 6-10%, along with about 0.1-1% manganese and up to 0.23% chromium is made by cold rolling aluminum alloy rolling stock to a cold reduction of at least 10% with or without prior hot rolling. Susceptibility to stress conversion cracking is overcome by heating the alloy to an elevated temperature of typically 600° or 700° F. or more followed by cooling the alloy at a controlled cooling rate of at least 10° F. per minute. The heating and the cooling precede the cold rolling operation and may be associated with hot rolling if such is employed.

32 Claims, No Drawings

LIGHTWEIGHT ARMOR PLATE AND METHOD

BACKGROUND OF THE INVENTION

Because of their light weight, aluminum alloys have found wide use in military applications, including military vehicles such as personnel carriers. The light weight of aluminum allows for improved performance and ease of transporting equipment, including air transport of military vehicles. In some vehicles, it is advisable to provide shielding or protection against assault, such as by providing armor plate to protect the occupants of the vehicle. Aluminum has enjoyed substantial use as such armor plate, military specifications pertaining to certain aluminum alloys for armor plate applications applying thereto.

Basically, the requirements for aluminum alloy armor plate are resistance to projectiles, good corrosion resistance, and, in some applications, good weldability. Ballistics tests are often conducted with armor-piercing projectiles such as 0.30 caliber and with fragment-simulating projectiles such as the common 20 millimeter projectile. Obviously, aluminum alloys which satisfy all the requirements for armor plate are desirable, and these desires have been met to varying degrees.

Aluminum Alloys 5083 and 5456 are covered in U.S. Military Specification for armor plate MIL-A-46027E (December 1973, amended May 1975) and MIL-A-46027F (1973, revised June 1976, amended October 1981), all incorporated herein by reference and Aluminum Alloy 7039 in U.S. Military Specification MIL-A-46063E, also incorporated herein by reference. It is generally recognized that for many app-lications AA 7039 armor plate is superior to AA 5083 armor plate, but the advantage is more for armor-piercing ballistic performance and less for fragment simulation performance, at least according to the military specifications. In fact, in thinner gauges AA 5083 armor plate can even sometimes perform better than AA 7039 and AA 7039 can present corrosion or stress corrosion problems to a greater degree than AA 5083 or AA 5456 and is heavier.

The production of 5083 and other 5XXX alloys for armor plate application has, since before the 1970's, normally included hot rolling more than 50% followed by cold rolling to a cold reduction of 10 to 25 or 30%, typically cold rolling about 20%. This was often followed by stretching the cold rolled plate to straighten or flatten it. These practices, as will be appreciated, have been common in the production of various 5XXX-type alloy armor plate products for many years, it being well recognized that hot rolling is a most common way of "breaking down" a large thick ingot into a plate for cold rolling to produce work-hardened Al-Mg alloy plate or sheet products. Cold rolling a 5XXX aluminum alloy produces strain-hardened tempers called H1X tempers, such as H12, H14, H16, with the second digit correlating roughly with the degree of work hardening and strength development. For instance, H14 is stronger than H12, and so on. A third digit is sometimes employed to indicate a special degree of control which does not take the temper outside the characteristics of the first two digits such that H131 is an H13 temper with further or narrower controls to achieve a narrower band of properties which are nonetheless within H13 general type properties. The common cold reductions in prior art (since the 1970's) aluminum 5XXX armor plate (17 to 23%) produced H13 level strength.

While aluminum alloy armor plate, particularly Al-Mg alloy (5XXX alloy) plate, has enjoyed substantial use as armor plate in military vehicles, there remains substantial room for improvement in increased strength and ballistic performance and decreased weight. One such approach exemplified by U.S. Pat. No. 4,469,537 is to very slightly shift the magnesium content upwardly, the method of producing the armor plate being the same as for 5083 and 5456, that is, hot rolling followed by cold rolling a plate, the cold rolling amounting to approximately 20% as was the practice in the prior art.

Substantial increases in magnesium offer benefits of substantially improved strength and ballistics performance along with slightly reduced weight since magnesium is lighter than aluminum. It is recognized, however, that increasing the level of magnesium introduces problems in stress corrosion cracking where significant amounts of cold work are imparted to the sheet or plate product, for instance, amounts of cold work in excess of 10% or 15% as is explained in U.S. Pat. No. 3,708,352, incorporated herein by reference. That patent explains that prior art recognized the corrosion problem in aluminum-magnesium alloys which receive substantial cold work, especially as the magnesium content is increased, and that by eliminating the cold rolling and employing instead warm rolling, the stability of the product was substantially improved such that resistance to stress corrosion cracking was generally acceptable, but resistance to exfoliation was not improved. Thus, in accordance with said U.S. Pat. No. 3,708,352, special thermal controls during or after hot rolling were employed to alleviate the exfoliation problem in the product which was hot and warm rolled.

SUMMARY OF THE INVENTION

In accordance with the present invention, employing relatively high amounts of magnesium, well above those used in AA 5083 and even well above the high magnesium content of AA 5456 armor alloy, results in high-performance lightweight aluminum armor plate provided certain fabrication practices are employed. Those fabrication practices typically include hot rolling followed by cold rolling and special controls associated with the hot rolling procedures wherein special temperature controls are employed to achieve high resistance to stress corrosion cracking in lightweight aluminum armor plate with high magnesium content. The special temperature controls include maintaining relatively high temperatures through the hot rolling operation followed by controlled cooling at 10° F. minimum per minute or include cooling to lower temperatures during hot rolling but controlling the cooling rate at that step. Another embodiment includes applying a heating step coupled with the aforesaid cooling after hot rolling.

DETAILED DESCRIPTION

The alloy in accordance with the invention contains relatively high amounts of magnesium as indicated earlier. The magnesium content is about 6% to about 8%, all percentages herein being by weight. A preferred minimum for magnesium is about 6.3% with a more preferred minimum being about 6.6%. A preferred maximum for magnesium is about 7.8%, more preferably about 7.4%. Manganese is present in the alloy in an amount of about 0.1% up to about 1%. A preferred minimum for manganese is 0.3%. A preferred maximum for manganese is about 0.8%, more preferably about 0.5%. Chromium may be present in amounts of up to about 0.23%. A preferred minimum for chromium is about 0.05%, more preferably about 0.06% or 0.065%. A preferred maximum for chromium is about 0.20%, more preferably about 0.15%. All percentages referred to herein are percent by weight, and the balance of the alloy is aluminum and incidental elements and impurities. For instance, iron may be present in amounts of up to 0.3%, preferably not over 0.25% or 0.2%. Silicon may be present in amounts of up to 0.15% or possibly 0.2%, but preferably not significantly above 0.1%. Copper may be present in amounts of up to 0.15% or possibly 0.2%, but preferably is not present in amounts significantly above 0.1%. Zinc may be present in amounts of up to 0.7% or possibly 0.8%, but is preferably kept below about 0.5%, more preferably not exceeding 0.3% or 0.4%. The alloy may include some amount of titanium such as about 0.001% to about 0.05%, but preferably not significantly exceeding 0.04%. Zirconium may likewise be included in the alloy in amounts of about 0.001% to about 0.1%. Generally speaking, higher amounts of magnesium can limit the cumulative amount of Mn, Cr, Fe, and Ti because of coarse intermetallic particle formation.

The foregoing composition ranges for the armor plate alloy refer to certain preferred practices. However, in a broader sense, the improvement can apply to aluminum armor plate alloys containing from about 5% to 10% or 11% magnesium, with or without other elements, including those mentioned above.

In producing the armor plate product, the alloy is formulated and then cast into an ingot such as by semi-continuous direct chill casting or roll casting or moving track or block or moving belt type casting. The ingot may typically be 10 to 25 or more inches in thickness in the case of direct chill ingot with width commensurate with the desired product and rolling mill capability. In the case of roll or moving belt type casting, the ingot, of course, would be thinner.

The ingot is scalped if necessary and, prior to hot rolling if used, preheated which can include homogenizing at a temperature of 900° F. to 1000° F. The metal is then cooled to room temperature and reheated to hot rolling temperature or cooled from homogenizing temperature to hot rolling temperature.

Hot rolling is initiated typically at a temperature of 700° to 900° F. It is during the hot rolling operation or shortly after the hot rolling operation, or both, when the temperature is controlled in accordance with one practice of the invention. In accordance with a preferred practice of the invention, metal temperature throughout the hot rolling operation is maintained above 600° F. or preferably 700° F., more preferably above 800° F. during the hot rolling operation. It is desired that temperatures below 550° at any point, even hot rolling mill exit, be avoided. By controlling the amount of rolling energy applied to the metal and the amount of lubricant or coolant applied to the metal, its temperature can be controlled during the hot rolling operation. It is to be appreciated that increasing the amount of rolling energy applied to the metal as by increasing the percent reduction per pass in the reversing mill tends to increase the temperature of the metal being hot rolled. It is even possible to increase the metal temperature exiting a roll pass to a level higher than the temperature entering the roll pass. Decreasing the amount of rolling energy applied to the metal during rolling as by decreasing the percent reduction or "draft" tends to favor lower temperatures exiting the hot roll pass. Higher hot rolling exit temperatures are also favored by reducing the amount of lubricant or coolant applied during the hot rolling pass. It is generally recognized that hot rolling lubricants have a cooling effect on the metal as it is being rolled such that applying more lubricant or coolant tends to reduce the temperature of the metal exiting the hot roll pass, whereas reducing the amount of lubricant or coolant applied tends to increase the temperature of the metal exiting a hot roll pass. Hence, the term "coolant" is used herein to include lubricants such as employed in hot rolling.

In accordance with the preferred practice wherein hot rolling is carried out at relatively high temperatures such that the exit temperature for the metal exiting the hot rolling operation is at least 600° F., the aforementioned balancing of hot rolling draft reductions and coolant or lubricant application can be employed to achieve the desired exit temperature. After exiting the last hot rolling pass, the metal is subject to controlled cooling to a temperature below 200° F., preferably below 150° F. The controlled cooling envisioned in practicing the invention is relatively rapid but need not be as rapid as a quench. That is, for aluminum alloys "rapidly cooling" normally refers to quenching in water as would normally be associated with the term "rapid cool", but the controlled cooling in practicing the invention need not be that drastic. In quenching, a cooling rate in excess of 100° F. per second is normally encountered, whereas in practicing the present invention, cooling rates of 10° F. per minute or higher are tolerable, rates in excess of 20° F. or 25° F./minute or 30° or 40° F./minute being better. Generally speaking, the faster cooling is better than slower, but it needs to be appreciated that the expense of a 100° F. per second quench rate is not absolutely necessary in practicing the invention. The controlled cooling is, however, considerably faster than simple air cooling for which a typical cooling rate for 1-inch thick aluminum plate standing on end is about 7° F. per minute or less. Typical mill practice where horizontal hot plate pieces are stacked would be even much slower.

One convenient means of achieving adequate cooling in practicing the present invention is to employ one or two zero reduction passes through the hot reversing mill while applying substantial amounts of coolant or lubricant to the plate as it passes through the mill. Such a pass can be referred to as a "dead pass" since no reduction is taken and no working is applied to the metal. One or more of such "dead passes" can be employed, typically 4 or 5, especially with substantial amounts of coolant or lubricant to bring the plate temperature below 200° F. or 100° F. at a rate of 20° F. per minute or more after which the cooling rate becomes less important.

Thus, in practicing the invention according to one embodiment the metal is heated or brought to elevated temperature and hot rolled at temperatures above 600° F. followed by controlled cooling. In this embodiment, substantial hot rolling reductions can be taken at relatively low coolant rate applications to favor high hot rolling temperatures (and maintaining such temperatures) which then is followed by zero or substantially zero reductions, or possibly relatively minor reductions, at relatively high or substantial rates of coolant application in order to cool the plate in accordance with the invention.

Another approach could be to install a quench-type chamber along the conveyor table roll system for moving hot rolled plate to the next operation such as the shearing operation preceding cold rolling.

In another embodiment, the thermal effect is applied after hot rolling. According to this embodiment, the metal is heated to an annealing-type temperature of about 600° to 900° F., preferably about 600° to 700° F., and held at this temperature for a sufficient time to substantially dissolve Mg-Al phases, typically about 1 or 2 to 10 hours. Following this, the metal is cooled as explained above, that is, at a rate above 10° per minute. In this embodiment, the hot rolling operation can proceed without special controls, and the thermal treatment functions something like a solution heat treatment, although it is to be appreciated that the particular alloys according to the invention are not of the type normally considered solution heat-treatable. The controlled cooling functions in a manner similar to quenching, but as just indicated, the alloy system according to the invention is not a heat-treatable alloy.

Still another embodiment of the invention includes bringing the metal to an elevated temperature for hot rolling and cooling during the hot rolling operation rather than after the hot rolling operation, or a combination of cooling during and after the hot rolling operation. What is important here is that the cooling always be at a rate equal to or greater than 10° F. per minute.

Thus, from what has preceded it becomes apparent that the special cooling procedure can be applied at varying points in association with the hot rolling operation. In one embodiment, the special cooling treatment is applied after hot rolling, which hot rolling is controlled to be completed at a high temperature. Another embodiment permits hot rolling to proceed without any special control in accordance with the invention, but after hot rolling the metal is brought to elevated temperature and held for a sufficient time to allow soluble elements to dissolve, and this is followed by relatively controlled cooling. A third embodiment contemplates bringing the metal to elevated temperature, commencing hot rolling, and applying the controlled cooling during the hot rolling operation itself, although this third embodiment is somewhat less preferred than the other embodiments.

Following the hot rolling operation, the metal is cold rolled to increase its strength. In accordance with the invention, the metal is cold rolled to reductions of at least 10% or 15% or more. Cold rolling reductions of 17% or 18% to about 25% or 30% are useful in practicing the invention, but reductions within the range of about 17% or 18% to about 24% or 25% are preferred in some embodiments. Cold reductions exceeding 30 or 40%, while useful, can result in production problems, especially on thick plate.

Prior to cold rolling, it is preferred that there be no annealing treatment, or if one is applied, it be followed by a controlled cooling of at least 10° F. per minute, that is, with the exception of the embodiment where the metal is heated and control-cooled after the hot rolling operation, it is preferred not to disturb the condition of the metal resulting from the controlled cool from high hot rolling temperature by imposing an annealing treatment on the metal. An exception in the practice of the invention occurs in the embodiment where the metal is heated and solutionized after hot rolling. This, of course, involves applying the controlled cooling at that point. In order to preserve the condition resulting from that treatment, it is preferred to refrain from heating unless followed by controlled cooling.

To this point, the invention has been described in terms of embodiments wherein hot rolling is used prior to cold rolling. However, the practice of the invention also applies to production without hot rolling such as where stock is cast in a thickness suited for cold rolling directly. An example is continuous plate casting such as roll casting a plate suitable for cold rolling. If the metal exiting a continuous plate caster is hot enough to keep the Al-Mg phase in solution, the controlled cooling can be applied to the plate exiting the caster. Alternatively, continuous cast plate can be heated to about 600° to 900° F. for a sufficient time to substantially dissolve the Mg-Al phases, typically about 1 or 2 to 10 hours, followed by controlled cooling in accordance with the invention, and then cold rolling to final gauge.

To illustrate the practice of the invention, a number of plate samples were prepared in accordance with the invention by hot rolling above 600° F. followed by controlled cooling. The composition of those samples, Samples A through G, are shown in Table I, together with the plate thickness and the percent cold work employed in the production of the plate. Table II shows for each plate sample mechanical properties and ballistics performance. Ballistics performance data at 0° obliquity are based on the velocity in feet per second required to produce a 50% probability of ballistic failure, either by penetration or by spalling. Just beside each velocity figure is an improvement factor (IF) where, for instance, 1.10% indicates the velocity indicated is 1.10 times the minimum for Alloys 5083 and 5456. In Table II it can be seen that relatively modest amounts of cold work produced plate in accordance with the invention having ballistics performance substantially above the minimums in the Military Specification for Alloys 5083 and 5456.

TABLE I

| Sample | Composition | | | | | | | |
|---|---|---|---|---|---|---|---|---|
| No. | Si | Fe | Cu | Mn | Mg | Cr | % CW | Thickness (in.) |
| A | .07 | .08 | .03 | .35 | 6.83 | .11 | 24 | 0.510 |
| B | .07 | .09 | .03 | .35 | 6.94 | .07 | 22 | 1.021 |
| C | .08 | .08 | .05 | .43 | 6.83 | .11 | 22 | 1.524 |
| D | .06 | .05 | .00 | .50 | 7.35 | .11 | 18 | 1.504 |
| E | .06 | .06 | .00 | .54 | 7.45 | .10 | — | 1.553 |
| F | .06 | .06 | .01 | .51 | 7.42 | .09 | 22 | .998 |
| G | .07 | .06 | .02 | .50 | 7.06 | .11 | 16 | 1.011 |

TABLE II

| Sam- | Mechanical Properties | | | 30 AP | | 20 FSP | |
|---|---|---|---|---|---|---|---|
| ple | Yield | U.T.S. | Elongation | | | | |
| No. | (ksi) | (ksi) | (%) | ft./sec. | I.F. | ft./sec. | I.F. |
| A | 51.4 | 61.9 | 16.0 | 1481 | n.a.* | — | — |
| B | 49.3 | 63.1 | 16.5 | 1987 | 1.08 | 1468 | 1.02 |
| C | 48.1 | 59.8 | 18.0 | 2532 | 1.07 | 2678 | 1.10 |
| D | 48.6 | 62.8 | 15.0 | 2575 | 1.10 | 2671 | 1.12 |
| E | 49.0 | 62.4 | 16.2 | 2624 | 1.10 | 2846 | 1.13 |
| F | 52.6 | 67.6 | 15.0 | 2004 | 1.10 | 1473 | 1.06 |
| G | 48.5 | 63.0 | 14.8 | 2014 | 1.10 | 1503 | 1.06 |

*n.a. - no minimum specification for 0° obliquity test for plate less than 0.940-inch thick Further samples of composition D from Table I were prepared by hot and cold rolling to produce armor plate specimens. The tensile properties of these plate specimens, corresponded closely with the data in Table II for Sample D. "C" ring specimens were cut from the plate in the manner described in ASTM G38 and stress corrosion cracking tests were performed in accordance with ASTM G44 procedures employing 3.5% NaCl solution, except that the G44 procedure was modified by using a more aggressive water so as to deliberately take the specimens to failure. The applied stress was 30 ksi and 35 ksi and the days to failure are indicated in Table III. It is to be understood that Sample 1 in Table III was made in accordance with the invention by heating the metal to a temperature of about 950° F. and holding at that temperature for about 8 hours prior to hot rolling. Hot rolling was carried out by applying relatively limited amounts of coolant-lubricant in the hot rolling procedure to maintain the hot rolling temperature above 650°. After the desired hot rolling thickness was reached, the plate was cooled at a rate of approximately 30°–40° F. per minute by using "dead pass" cooling wherein the plate was passed back and forth through the rolling mill with no draft or reduction being taken and substantial amounts of coolant-lubricant being applied to the plate. This cooling brought the temperature of the plate below about 150° F. Without annealing, the plate was cold rolled to a reduction of a little over 18%.

Sample 2 was produced without special controls during hot rolling. However, after hot rolling to the desired hot rolling gauge, the metal was heated to a temperature within the range of 600° to 700° F. and held at that temperature for about 2 hours. Following this, the plate was cooled with water. The cooling brought the plate down to a temperature of about 100° F. or a little less, considerably faster than 30° per minute.

Sample 3 was produced by simply hot rolling followed by cold rolling, which procedure is in general accordance with the practices normally employed in the industry to produce aluminum-magnesium alloy armor plate. The results of the stress corrosion tests are shown in Table III, it being emphasized that the purpose of this relatively severe test was to drive the specimens to failure. An indication of success in this type of test is if all specimens survive 10 or more days at a stress level of 30 ksi. Alloys 5083 and 5456 would pass this test, but Alloy 7039 would not pass this test.

TABLE III

STRESS-CORROSION TESTS

| Sample No. | Stress - 30 ksi F/N | Stress - 30 ksi DAYS | Stress - 35 ksi F/N | Stress - 35 ksi DAYS |
|---|---|---|---|---|
| 1 | 8/9 | 19,23,23,23,25,28,29,36 | 8/9 | 13,19,19,25,28,28,33,33 |
| 2 | 9/9 | 13,13,13,13,13,17,17,19,24 | 9/9 | 13,17,17,19,19,19,24,28,36 |
| 3 | 9/9 | 3,3,7,7,9,9,9,9,9 | 9/9 | 3,3,3,3,4,4,5,5,13 |

From Table III it can be seen that Sample 1 in accordance with the invention shows a marked improvement over Sample 3 which is the same composition produced in accordance with conventional practices. Much the same can be said for Sample 2. It is to be noted that in Sample 1 only 8 of the 9 specimens tested failed within the 90-day test period.

From all of the foregoing it can be seen that the present improvement enables the production of effective projectile resistance armor plate at modest levels of cold rolling to produce a lightweight aluminum-magnesium alloy armor plate having very acceptable resistance to stress corrosion cracking, which resistance is achieved by special thermal-cooling practices in accordance with the invention.

While the invention has been described in terms of preferred embodiments, the claims appended hereto are intended to encompass all embodiments which fall within the spirit of the invention.

What is claimed is:

1. In the method of producing improved aluminum-magnesium alloy armor plate, wherein aluminum-magnesiums alloy is cold rolled to a reduction of at least 10% to produce cold-rolled plate, the imrpovement comprising:

(a) providing an aluminum alloy consisting essentially of about 6 to 10% magnesium, about 0.1 to 1% manganese, 0.05 to 0.23% chromium, balance aluminum and incidental elements and impurities;

(b) heating said alloy to a temperature of at least 600° F.;

(c) cooling said alloy at a controlled cooling rate of at least 10° F. per minute down to a temperature of 200° F. or less; and (d) cold rolling said alloy.

2. The method according to claim 1 wherein said heating to a temperature of at least 600° F. is performed before a hot rolling operation and said controlled cooling is performed subsequent to substantial hot rolling reductions.

3. The method according to claim 2 wherein hot rolling reductions in excess of 50% are taken at a temperature in excess of 600° F. after which the said metal is cooled at a rate of at least 10° F. per minute.

4. The method according to claim 2 wherein said heating to a temperature of at least 600° F. is performed before a hot rolling operation and the amount of hot rolling reduction and the amount of coolant applied during said hot rolling reduction are controlled to favor maintaining a temperature of above 600° F. during said hot rolling operation.

5. The method according to claim 4 wherein at the conclusion of hot rolling reductions the metal is cooled according to said cooling rate by application of coolant in the hot rolling mill operation including passing the metal through the hot rolling rolls while not taking a substantial reduction.

6. The method according to claim 2 wherein at the conclusion of hot rolling reductions the metal is cooled according to said cooling rate by application of coolant in the hot rolling mill operation including passing the metal through the hot rolling rolls while not taking a substantial reduction.

7. The method according to claim 5 wherein in said cooling operation in said hot rolling mill the reduction per pass is substantially nil.

8. The method according to claim 2 wherein in said cooling operation in said hot rolling mill the reduction per pass is substantially nil.

9. The method according to claim 2 wherein the amount of coolant applied to the metal in the cooling operation substantially exceeds that applied during the hot rolling operation.

10. The method according to claim 4 wherein the amount of coolant applied to the metal in the cooling operation substantially exceeds that applied during the hot rolling operation.

11. The method according to claim 5 wherein the amount of coolant applied to the metal in the cooling operation substantially exceeds that applied during the hot rolling operation.

12. The method according to claim 7 wherein the amount of coolant applied to the metal in the cooling operation substantially exceeds that applied during the hot rolling operation.

13. The method according to claim 1 wherein substantially no hot rolling follows said heating to at least 600° F.

14. The method according to claim 1 wherein one or more hot rolling steps precede and follow said heating to at least 600° F.

15. The method according to claim 1 wherein said alloy contains 0.05 to 0.23% chromium.

16. The method according to claim 1 wherein said cooling rate is at least 30° F. per minute.

17. The method according to claim 1 wherein said cooling rate is at least 40° F. per minute.

18. The method according to claim 1 wherein said heating is to a temperature of at least 700° F.

19. In the method of producing improved aluminum armor plate wherein an aluminum-magnesium alloy is hot and cold rolled, the improvement comprising:

(a) providing an aluminum alloy consisting essentially of about 6 to 8% magnesium, about 0.1 to 1% manganese, up to 0.23% chromium, balance aluminum and incidental elements and impurities;

(b) heating said alloy to a temperature of at least 600° F.;

(c) hot rolling said aluminum to produce a hot rolled plate product, said hot rolling being affected at temperatures maintained above 600° F. substantially throughout said hot rolling;

(d) cooling said hot rolled plate product at a rate of at least 10° F. per minute; and (e) cold rolling said hot rolled plate product to a cold roll reduction of at least 15%.

20. The method according to claim 19 wherein the amount of hot rolling reductions and the amount of coolant applied during said hot rolling reductions are controlled to favor maintaining a temperature of above 600° F. during said hot rolling operation.

21. The method according to claim 20 wherein at the conclusion of hot rolling reductions the metal is cooled according to said cooling rate by application of coolant in the hot rolling mill operation including passing the metal through the hot rolling rolls while not taking a substantial reduction.

22. The method according to claim 20 wherein in said cooling operation in said hot rolling mill the reduction per pass is substantially nil.

23. The method according to claim 20 wherein the amount of coolant applied to the metal in the cooling operation substantially exceeds that applied during the hot rolling operation.

24. The method according to claim 1 wherein the magnesium content is at least 6.3%.

25. The method according to claim 1 wherein the magnesium content is at least 6.6%.

26. The method according to claim 19 wherein the magnesium content is at least 6.3%.

27. The method according to claim 19 wherein the magnesium content is at least 6.6%.

28. Armor plate produced according to claim 1.

29. Armor plate produced according to claim 4.

30. Armor plate produced according to claim 19.

31. Armor plate produced according to claim 24.

32. Armor plate produced according to claim 26.

* * * * *